US006473109B1

(12) United States Patent
Lai

(10) Patent No.: US 6,473,109 B1
(45) Date of Patent: Oct. 29, 2002

(54) RIBBON CARTRIDGE STRUCTURE FOR PRINTING HEAD OF LARGE COLOR PRINTER

(75) Inventor: Jin-Sheng Lai, Hsi-Chih (TW)

(73) Assignee: Great Computer Corp., Hsi-Chih (TW)

( * ) Notice: Subject to any disclaimer, the term of this patent is extended or adjusted under 35 U.S.C. 154(b) by 0 days.

(21) Appl. No.: 09/987,066

(22) Filed: Nov. 13, 2001

(51) Int. Cl.[7] ..... B41J 32/00; B41J 35/28

(52) U.S. Cl. ..... 347/214; 400/208.1; 400/207; 400/208

(58) Field of Search ..... 347/214; 400/207, 400/208, 208.1

(56) References Cited

U.S. PATENT DOCUMENTS 5,352,048 A * 10/1994 Mizoguchi et al. ..... 400/208

* cited by examiner

*Primary Examiner*—Huan Tran

(74) *Attorney, Agent, or Firm*—Dennison, Schultz & Dougherty

(57) ABSTRACT

A ribbon cartridge structure for a printing head of a large printer, the structure has a ribbon cartridge, an external and an inner clamping piece, the ribbon cartridge is provided with an "L" shaped sheet member of which the two ends are respectively extended to connect with two cylinders. Each cylinder has a rotation axle, and has on the periphery thereof an opening for extending of a color ribbon therethrough. The "L" shaped sheet member is provided on both sides thereof with at least an engaging portion to respectively connect with the corresponding protruding portion on one side of and the corresponding hooking portion on the other side of each of the clamping pieces. The color ribbon is extended between the external and the inner clamping pieces. Thereby, the whole printer have the effects of firm connecting and convenient assembling, improved tidiness of the color ribbon and easiness of reeling the color ribbon.

5 Claims, 5 Drawing Sheets

RIBBON CARTRIDGE STRUCTURE FOR PRINTING HEAD OF LARGE COLOR PRINTER

BACKGROUND OF THE INVENTION

1. Field of the Invention

The present invention is related to a ribbon cartridge structure for a printing head of a large color printer, and especially to a ribbon cartridge structure for a printing head of a large color printer with the ribbon cartridge thereof arranged in cooperation with an external and an inner clamping piece to make the whole printer have the effects of firm connecting, convenient assembling, improved tidiness of the color ribbon and easiness of reeling the color ribbon.

2. Description of the Prior Art

The printing business has been generally computerized for quite a period of time by prevailing of modem information technique, it is well known that colored ink-jet printers for personal use have been very inexpensive, their resolution abilities are also very precise, plus the matching of the related software capable of elevating the quality of images, the printers can be used for output for prints of high quality images. However, they are only limited to output for small prints; ink-jet drawing equipment for larger size of prints is still kept at the high prices because of the higher cost and manufacturing technique due to the factors of requirement of resolution etc. Practically, not all larger prints want higher quality images, for example, canvas signs in the streets mostly are suspended high, the messages and images they are to express and show do not at all have too much difference in the sights of viewing of people. Higher quality image ink-jet printing presently costs higher, and competition in the markets of advertisement will be lost as well, hence the present invention is developed. Please refer to FIG. 1 showing a conventional printing box, whereon, a ribbon cartridge 2 is mated with the printing box 1, the ribbon cartridge 2 is provided with an "L" shaped sheet member 23 of which the two ends are respectively extended to connect with two cylinders 21 and 22. The two cylinders 21, 22 are provided on the peripheries thereof each with an opening 26 for extending of a color ribbon 27 therethrough. Thereby, signals of drawing accepted can heat selected points of the reeling color ribbon 27 to print an image. Although it has the object of heating selected points of the reeling color ribbon 27 to print an image, after heating selected points to print the image, the reeling color ribbon 27 may be loosened and deformed by heating to result deviation in reeling. Therefore, the printers have the defects of inferior tidiness as well as uneasiness of reeling color ribbons.

SUMMARY OF THE INVENTION

The primary object of the present invention is to provide a ribbon cartridge structure for a printing head of a large printer, wherewith, a color ribbon is extended between an external and a inner clamping piece, so that no loosening nor deformation of the color ribbon is resulted by heating selected points of the reeling color ribbon by the printing box to print an image and to in turn result deviation in reeling, thereby the color ribbon can be smoothly reeled into one of the cylinders, and practicability of the present invention is increased.

The second object of the present invention is to provide a ribbon cartridge structure for a printing head of a large printer; wherewith, by providing at least a protruding portion on one side of each of the: external and the inner clamping pieces and at least a hooking portion on the other side of each of the clamping pieces to respectively connect with corresponding engaging portions provided on both sides of an "L" shaped sheet member to make the whole printer have the effects of firm connecting and convenient assembling.

To get the above stated objects, the present invention has a ribbon cartridge thereof arranged to connect with the external and the inner clamping pieces, the ribbon cartridge is provided with the "L" shaped sheet member of which the two ends are respectively extended to connect with two cylinders. Each of the two cylinders is provided with a rotation axle, and is provided on the peripheries thereof each with an opening for extending of a color ribbon therethrough. The "L" shaped sheet member is provided on both sides thereof with at least an engaging portion to respectively connect with the corresponding protruding portion on one side of and the corresponding hooking portion on the other side of each of the clamping pieces. The color ribbon is extended between the external and the inner clamping pieces. Thereby, the whole printer have the effects of firm connecting and convenient assembling, increased tidiness of the color ribbon and easiness of reeling the color ribbon; thus practicability as well as convenience of the printer can be increased.

The present invention will be apparent in its features and structure after reading the detailed description of the preferred embodiment thereof in reference to the accompanying drawings.

DETAILED DESCRIPTION OF THE PREFERRED EMBODIMENT

Figure 1:
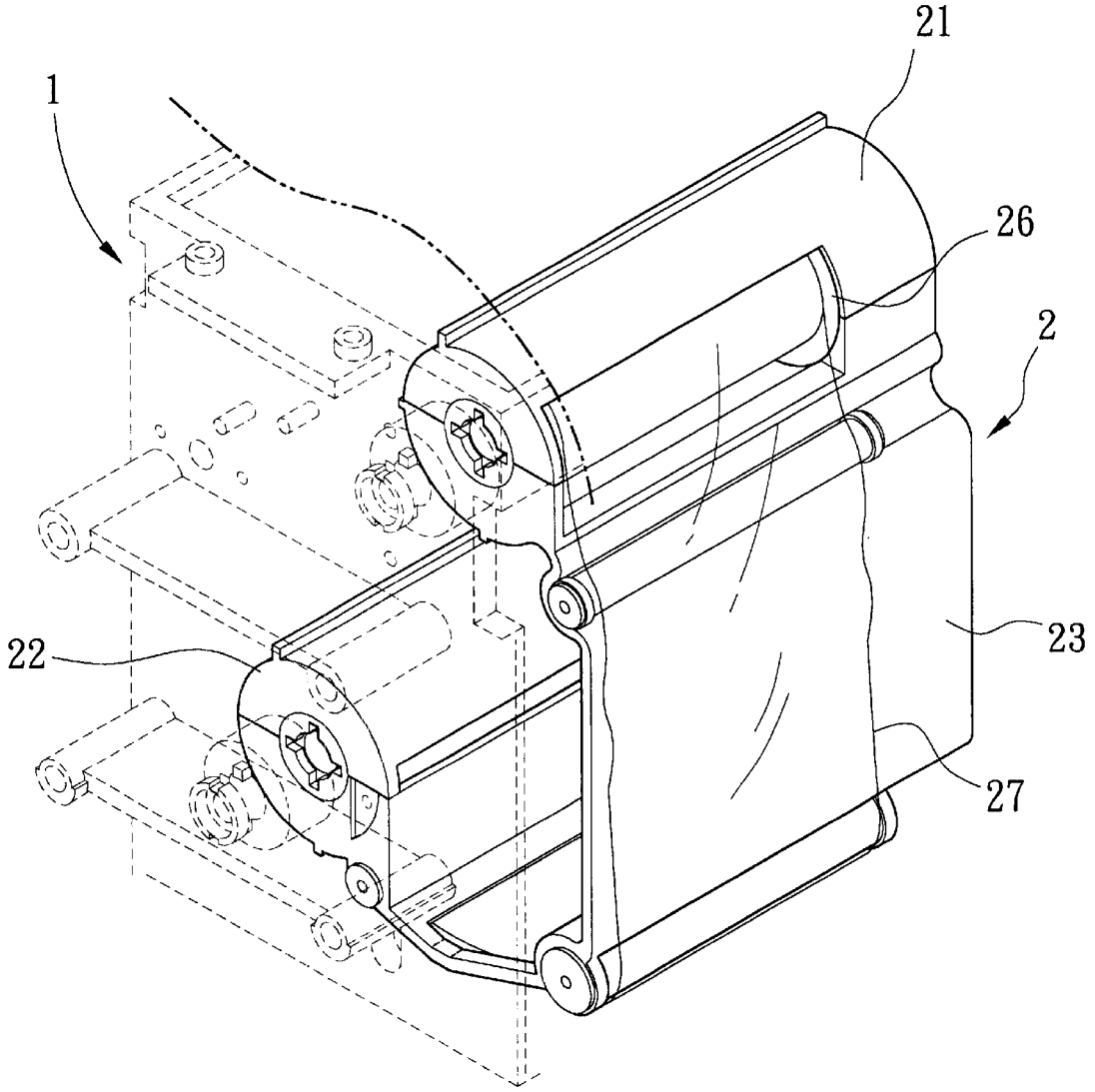
Fig. 1 (PRIOR ART)
FIG. 1 is a perspective view of a conventional printing box.
Figure 2:
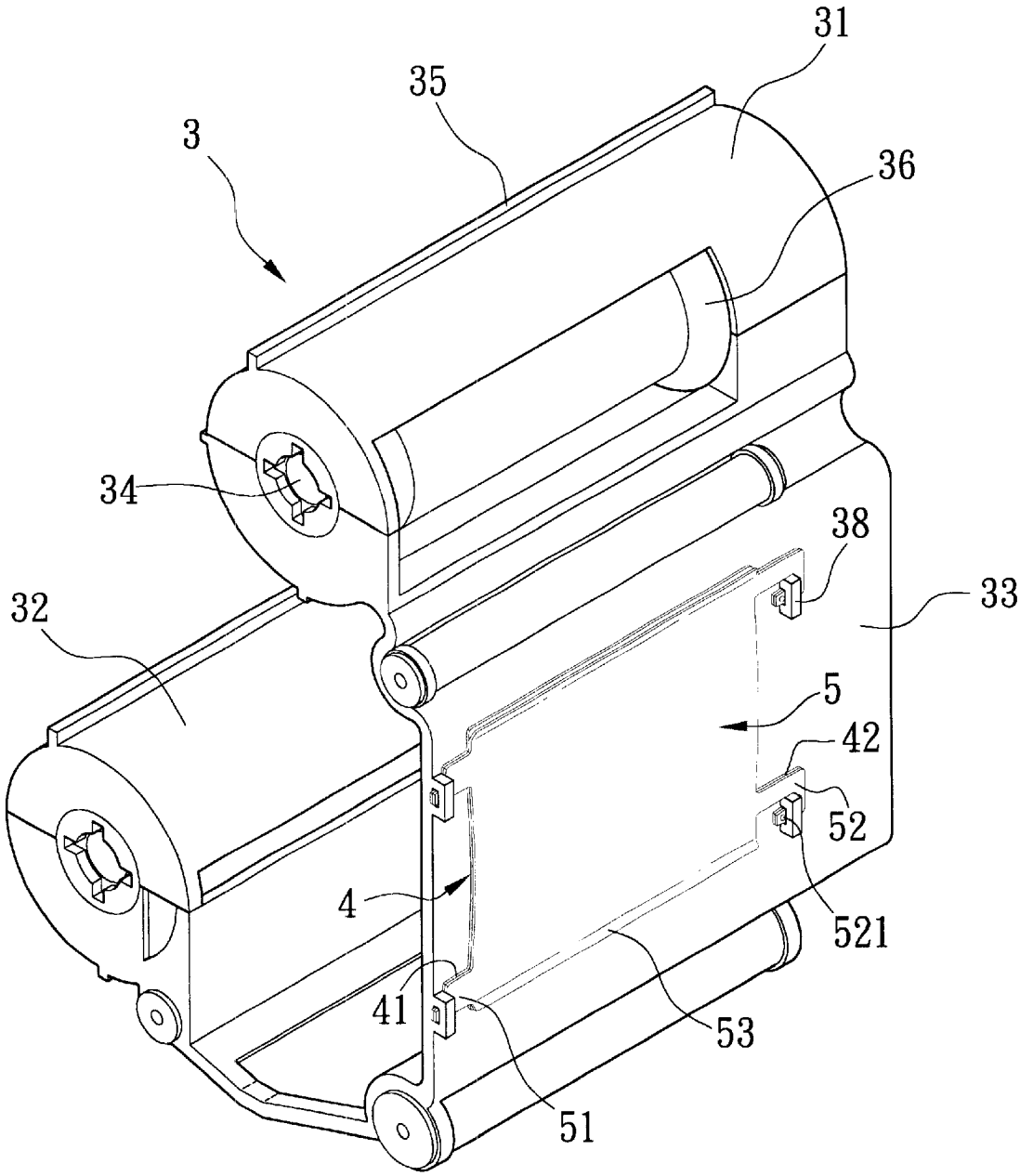
FIG. 2 is a perspective view of an embodiment of the present invention.
Figure 3:
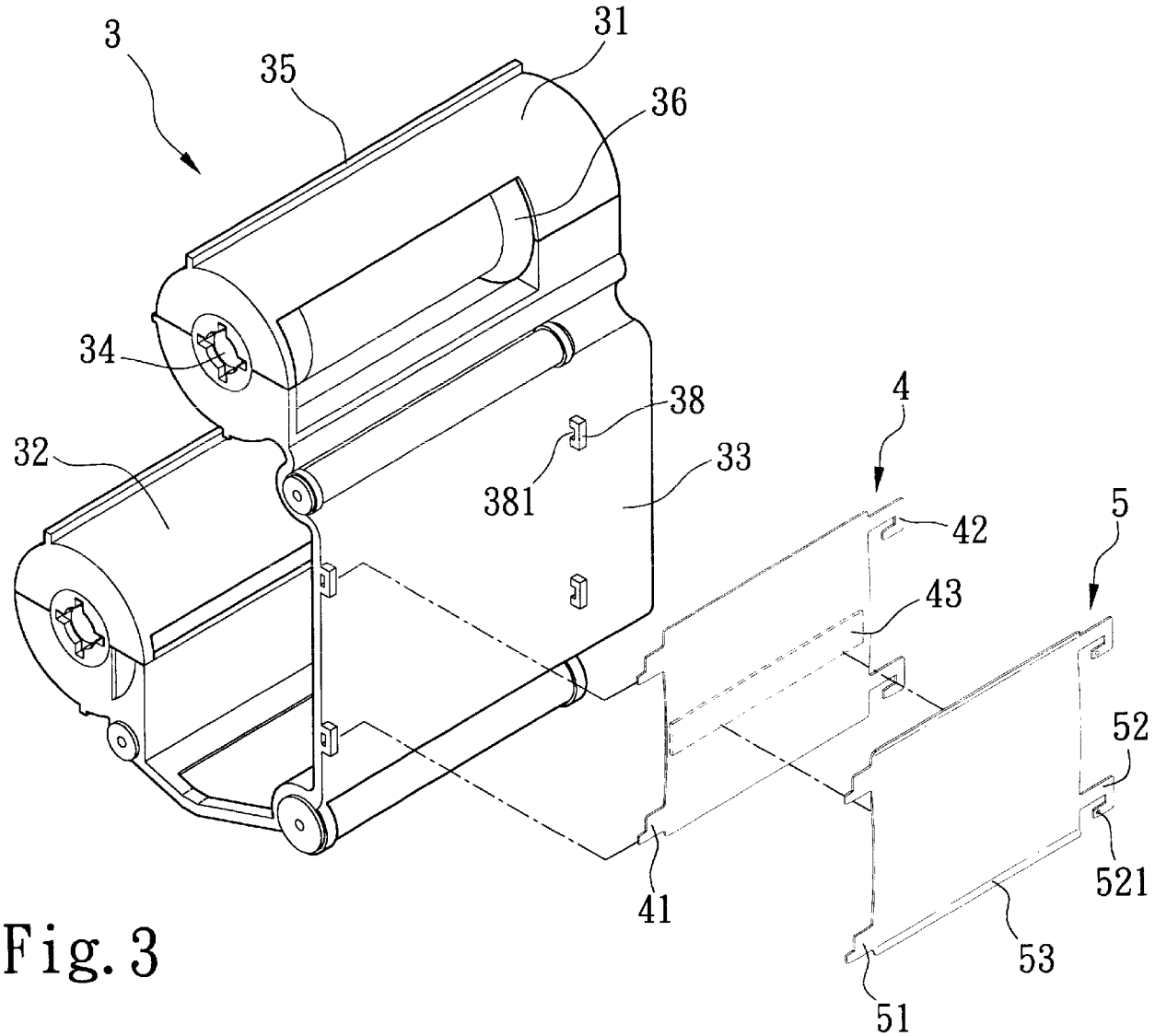
FIG. 3 is an analytical perspective view showing the elements of the embodiment of the present invention.
Figure 4:
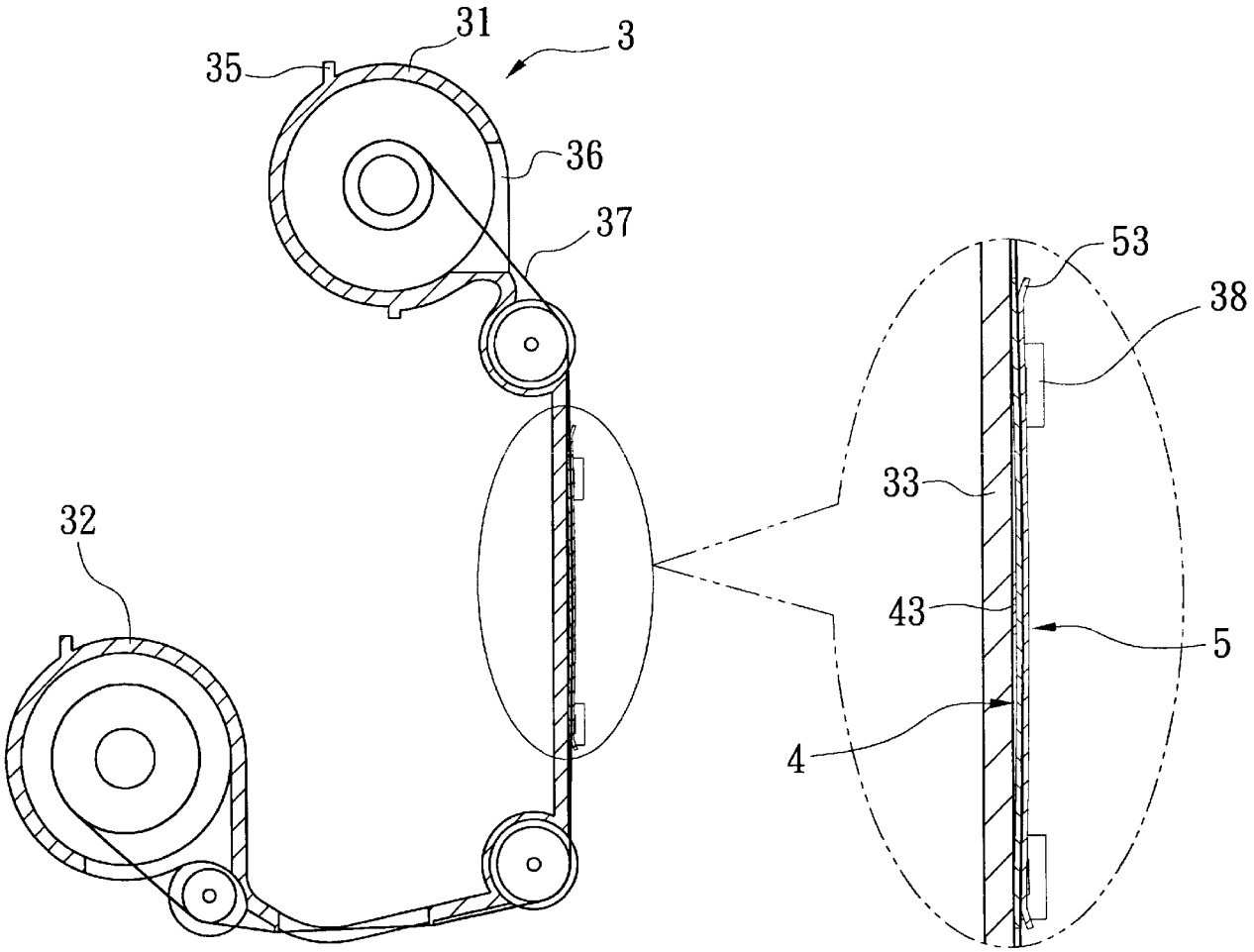
FIG. 4 is a sectional schematic view of the embodiment of the present invention.
Figure 5:
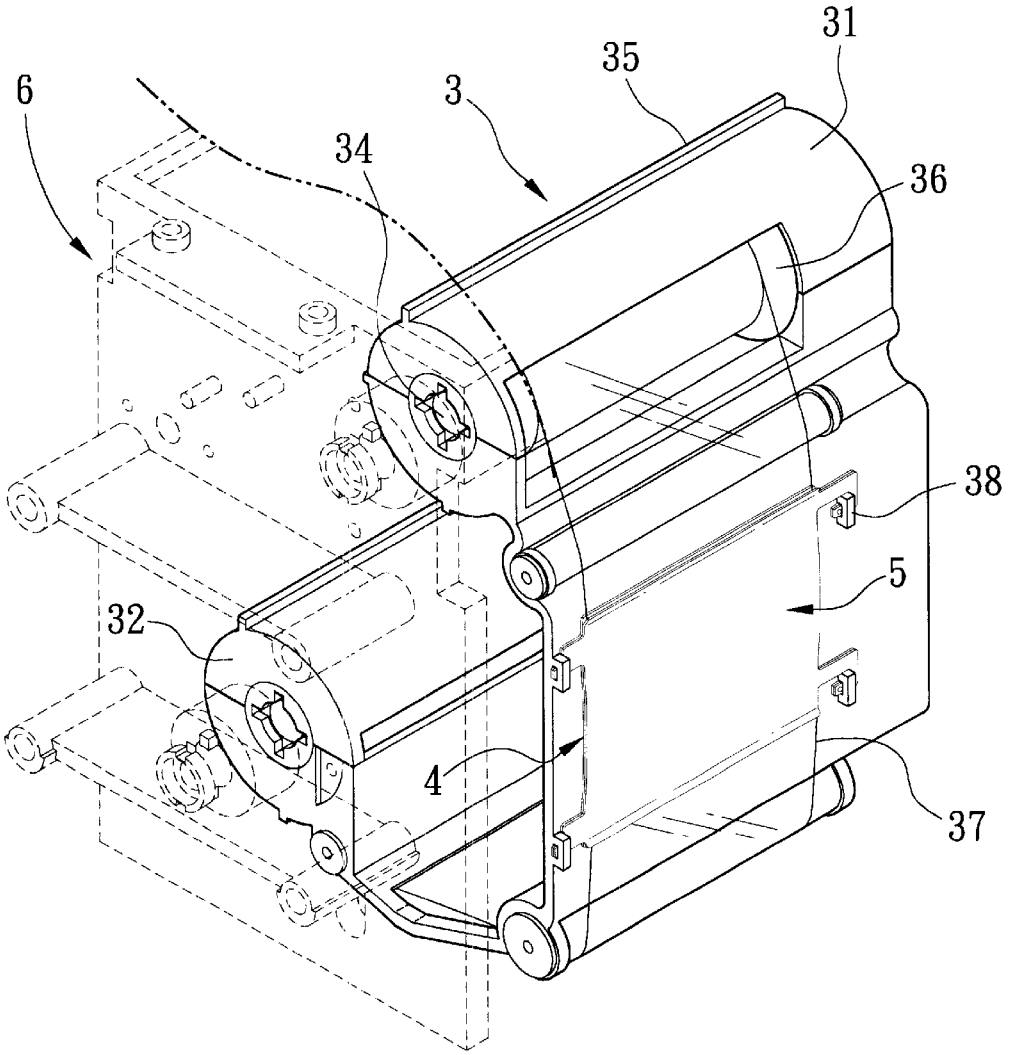
FIG. 5 is a schematic view showing application of the embodiment of the present invention.

Referring firstly to FIGS. 2–4, the ribbon cartridge structure for a printing head of a large printer of the present invention is comprised mainly of: a reel type ribbon cartridge 3, an inner clamping piece 4 and an external clamping piece 5.

The ribbon cartridge 3 is provided with an "L" shaped sheet member 33 of which the two ends are respectively extended to connect with two cylinders 31 and 32. The "L" shaped sheet member 33 is provided on both sides thereof with two engaging portions 38 each with an engaging hole 381. Each of the two cylinders 31, 32 is provided centrally with a rotation axle 34, and is provided on the bodies thereof each with an engaging strip 35 for alignment and on the peripheries thereof each with an opening 36 for extending of a color ribbon 37 therethrough.

The inner clamping piece 4 is a curved rectangular sheet, and is provided on one side thereof with two protruding portions 41, and is provided on the other side thereof with two hooking portions 42; the inner clamping piece 4 is provided centrally on the bottom thereof with a strip shaped pad 43 to keep the inner clamping piece 4 in the curved state.

The external clamping piece 5 is a curved rectangular sheet, it is disposed in an external and inner positional correlation with the inner clamping piece 4, the color ribbon 37 is extended between the external and the inner clamping pieces 5, 4. The external clamping piece 5 is provided on one side thereof with two protruding portions 51, and is provided on the other side thereof with two hooking portions 52 of which the ends have two protruding tips 521, and the front and the rear ends of the external clamping piece 5 have respectively a folded portion 53.

With the above stated ribbon cartridge structure for a printing head of a large printer constructed from the above members, referring to FIGS. 2–5, the present invention is characterized by that, the "L" shaped sheet member 33 of the ribbon cartridge 3 is provided at suitable positions on both sides thereof with the two engaging portions 38 in which the engaging holes 381 provided are engaged with the two protruding portions 41 on one side of the inner clamping piece 4 and are hooking connected with the two hooking portions 42 provided on the other side of the inner clamping piece 4, so that the ribbon cartridge 3 is firmly connected with the inner clamping piece 4. And the two protruding portions 51 provided on one side of and the two hooking portions 52 provided on the other side of the external clamping piece 5 make firm connection with the engaging hole 381; the two protruding tips 521 provided on the ends of the two hooking portions 52 make such connection with the engaging hole 381 even firmer. Therefore, the color ribbon 37 extended between the external and the inner clamping pieces 5, 4 will not be loosened nor deformed by heating selected points of the reeling color ribbon 37 by the printing box 6 to print an image and to in turn result deviation in reeling, and thereby the color ribbon 37 can be smoothly reeled into the cylinder 31. And the strip shaped pad 43 provided centrally on the bottom of the inner clamping piece 4 can keep the inner clamping piece 4 in the curved state to abut against the color ribbon 37 over it; this can make the color ribbon 37 extended between the external and the inner clamping pieces 5, 4 more smooth, and an arciform space formed below the inner clamping piece 4 renders the color ribbon 37 to get more heat sinking space. And the folded portions 53 provided on the front and the rear ends of the external clamping piece 5 render the color ribbon 37 to move in and out of the space between the external and the inner clamping pieces 5, 4 more easily. Thereby, the whole printer of the present invention has the effects of firm connecting, improved tidiness of the color ribbon and easiness of reeling the color ribbon; thus practicability of the printer can be increased, and the ribbon cartridge structure for a printing head of a large printer can be completed.

In FIGS. 2–5 of the present invention, the "L" shaped sheet member is provided on both sides thereof with two engaging portions; the external clamping piece is provided on one side thereof with two protruding portions, and is provided on the other side thereof with two hooking portions. Thereby, the whole printer can get the effects of firm connecting, improved tidiness of the color ribbon and easiness of reeling the color ribbon. However, practically, it needs only that the "L" shaped sheet member is provided on both sides thereof with at least one engaging portion at a suitable position; the external and the inner clamping pieces are each provided on one side thereof with at least one protruding portion, and are each provided on the other side thereof with at least one hooking portion, the whole printer can get the object of firm connecting, improved tidiness of the color ribbon and easiness of reeling the color ribbon.

The present invention has the following advantages:

1. The color ribbon in the present invention extended between the external and the inner clamping pieces will not be loosened nor deformed by heating selected points of the reeling color ribbon by the printing box to print an image and to in turn result deviation in reeling, and thereby the color ribbon can be smoothly reeled into the cylinder, practicality can thereby increased.
2. In the present invention, the external and the inner clamping pieces are each provided on one side thereof with at least one protruding portion and are each provided on the other side thereof with at least one hooking portion to connect with the corresponding engaging portions at the suitable positions on both sides of the "L" shaped sheet member, the whole printer can thereby get the object of convenient assembling and firm connecting.

In conclusion, the present invention not only can get rid of the defects resided in the conventional ribbon cartridges for printing heads of large color printers, and by the designing of connecting of the means of the external and the inner clamping pieces, the effects of firm connecting, improved tidiness of the color ribbon and easiness of reeling the color ribbon can be achieved. Hence practicality of the whole printer can thereby increased, the printer can suit various ribbon cartridges of various color printers.

What is claimed is:

1. A ribbon cartridge structure for a printing head of a large printer comprising:

a ribbon cartridge provided with an "L" shaped sheet member of which the two ends are respectively extended to connect with two cylinders being each provided centrally with a rotation axle, and being provided on the peripheries thereof each with an opening for extending of a color ribbon therethrough, said an "L" shaped sheet member is provided on both sides thereof with at least one engaging portion;

an inner clamping piece being a curved rectangular sheet, said inner clamping piece is provided on one side thereof with at least one protruding portion and is provided on the other side thereof with at least one hooking portion to connect with the corresponding ones of said engaging portions on both sides of said "L" shaped sheet member;

an external clamping piece being a curved rectangular sheet, it is disposed in an external and inner positional correlation with said inner clamping piece, said external clamping piece is provided on one side thereof with at least one protruding portion and is provided on the other side thereof with at least one hooking portion to connect with the corresponding ones of said engaging portions on both sides of said "L" shaped sheet member; said color ribbon extends through the space between said external and said inner clamping pieces.

2. A ribbon cartridge structure for a printing head of a large printer as in claim 1, wherein, said "L" shaped sheet member is provided on said engaging portions thereof each with an engaging hole to be engaged with said two protruding portions on said one side of said inner clamping piece and to be hooking connected with said two hooking portions provided on said other side of said inner clamping piece, so that said ribbon cartridge is firmly connected with said inner clamping piece.

3. A ribbon cartridge structure for a printing head of a large printer as in claim 1, wherein, said inner clamping piece is provided centrally on the bottom thereof with a strip shaped pad to keep said inner clamping piece in a curved state, and thereby said color ribbon is smoothly reeled between said external and inner clamping pieces to get more heat sinking space.

4. A ribbon cartridge structure for a printing head of a large printer as in claim 1, wherein, the ends of said hooking portions each has a protruding tip.

5. A ribbon cartridge structure for a printing head of a large printer as in claim 1, wherein, the front and the rear ends of said external clamping piece have respectively a folded portion.

* * * * *